US007255181B2

(12) United States Patent
Mocivnik et al.

(10) Patent No.: US 7,255,181 B2
(45) Date of Patent: Aug. 14, 2007

(54) METHOD AND DEVICE FOR THE DRILLING OF HOLES IN GROUND OR ROCKY MATERIAL

(75) Inventors: Josef Mocivnik, Fohnsdorf (AT); Renè Egger-Mocivnik, Judenburg (AT)

(73) Assignee: "Alwag" Tunnelausbau Gesellschaft m.b.H., Pasching (AT)

( * ) Notice: Subject to any disclaimer, the term of this patent is extended or adjusted under 35 U.S.C. 154(b) by 0 days.

(21) Appl. No.: 11/400,311

(22) Filed: Apr. 10, 2006

(65) Prior Publication Data

US 2006/0180352 A1 Aug. 17, 2006

Related U.S. Application Data

(63) Continuation of application No. PCT/AT2004/00340, filed on Oct. 5, 2004.

(30) Foreign Application Priority Data

Oct. 8, 2003 (AT) ..... A 1593/2003

(51) Int. Cl.
*E21B 7/20* (2006.01)

(52) U.S. Cl. ..... 175/22; 175/170; 175/320; 175/415

(58) Field of Classification Search ..... 175/415, 175/170, 320, 296, 22, 23, 314
See application file for complete search history.

(56) References Cited

U.S. PATENT DOCUMENTS 975,487 A * 11/1910 Welsh ..... 405/245
3,382,934 A * 5/1968 Spear ..... 175/171
5,205,366 A * 4/1993 Klemm ..... 175/390
5,259,469 A 11/1993 Stjernstrom ..... 175/385
5,284,216 A 2/1994 Brungs et al. ..... 175/385
5,921,332 A * 7/1999 Spedale, Jr. ..... 175/415
6,021,856 A * 2/2000 Pascale ..... 175/414
6,722,454 B2 * 4/2004 Mocivnik et al. ..... 175/171

FOREIGN PATENT DOCUMENTS

| | | |
|---|---|---|
| DE | 2155540 | 5/1973 |
| WO | WO00/57019 | 9/2000 |
| WO | WO03/001022 | 1/2003 |
| WO | WO03/004824 | 1/2003 |

* cited by examiner

*Primary Examiner*—Hoang Dang
(74) *Attorney, Agent, or Firm*—Jacobson Holman PLLC

(57) ABSTRACT

In a method and device for drilling, in particular percussion drilling or rotary percussion drilling, holes in soil or rock material, wherein a borehole is formed by a percussive and/or rotational movement carried out by a drill bit (1) mounted on a drill rod assembly (4) and an envelope tube and/or a jacket tube (15, 18) is introduced into the borehole, it is provided that the impact energy introduced by the drill rod assembly (4) is transmitted partially, particularly centrally, by the drill rod assembly (4) onto the drill bit (1) and partially via an impact shoe (10) cooperating with the drill rod assembly (4) onto the envelope and/or jacket tubes (15, 18), thus enabling the reliable introduction of the excavation or impact energy into the drill bit (1) as well as into the envelope and/or jacket tubes (15, 18).

13 Claims, 2 Drawing Sheets

METHOD AND DEVICE FOR THE DRILLING OF HOLES IN GROUND OR ROCKY MATERIAL

This is a continuation of PCT/AT2004/00340 filed Oct. 5 2004 and published in English.

FIELD OF THE INVENTION

The present invention relates to a method for drilling, in particular percussion drilling or rotary percussion drilling, holes in soil or rock material, wherein a borehole is formed by a percussive and/or rotational movement carried out by a drill bit mounted on a drill rod assembly and an envelope tube and/or a jacket tube is introduced into the borehole, wherein the impact energy introduced by the drill rod assembly is transmitted partially, particularly centrally, by the drill rod assembly onto the drill bit and partially via an impact shoe cooperating with the drill rod assembly onto the envelope and/or jacket tubes. The invention further relates to a device for drilling, in particular percussion drilling or rotary percussion drilling, holes in soil or rock material, wherein a borehole is formed by a percussive and/or rotational movement carried out by a drill bit mounted on a drill rod assembly and an envelope tube and/or a jacket tube is capable of being introduced into the borehole, wherein the drill bit is capable of being acted upon by the drill rod assembly in its central region and the drill rod assembly acts on an impact shoe cooperating with the envelope and/or jacket tubes.

PRIOR ART

In the context of methods and devices for drilling and, in particular, percussion drilling or rotary percussion drilling holes in soil or rock material, various embodiments are known. Thus, it is, for instance, known to couple a drill bit directly with a drill rod assembly for the introduction of impact energy where, for instance, an envelope and/or jacket tubes is introduced into the interior of the borehole under tensile stress by the drill bit, appropriate coupling between the envelope tube and/or the jacket tube and the drill bit being realized on the end facing away from the working surface. That embodiment involves the drawback that also the energy required for the introduction of the envelope and/or jacket tubes causing, for instance, friction resistances by partially abutting on the borehole wall must be introduced via the drill bit.

A method and device of the initially defined kind have become known from WO 03/004824, which aims to enable the simple removal of a raking element without actuation of the pilot drill bit.

In addition, embodiments are known, in which an accordingly sturdily designed envelope tube is provided, which cooperates with the drill bit particularly on the outer periphery of the same, such embodiments renouncing the use of a substantially central drill rod assembly for the introduction of impact energy. That embodiment, in particular, involves the disadvantage that a very sturdy and, hence, heavy jacket tube, which is usually provided for short-distance bores such as, for instance, well bores, has to be employed for the introduction of the required excavation energy.

Departing from a method and device of the initially defined kind, the present invention aims to enable the reliable and favorable introduction of excavation or impact energy into the drill bit as well as into the envelope and/or jacket tubes.

SUMMARY OF THE INVENTION

To solve these objects, a method of the initially defined kind is essentially characterized in that the impact energy is transmitted from the drill rod assembly onto the impact shoe via an interposed impact ring and that the drill bit and optionally the impact ring are coupled with the drill rod assembly by a plug-in connection. Since the energy or impact energy is transmitted onto the drill bit separately and, in particular, centrally by the drill rod assembly and partially onto the envelope and/or jacket tubes via an impact shoe cooperating with the drill rod assembly, decoupling during the introduction of the drill bit from the envelope and/or the jacket tubes to be additionally introduced during the drilling procedure is feasible. It is, thus, enabled to limit the excavation or impact energy to be transmitted onto the drill bit to just the extent required for drilling, whereby the forces required for the introduction of the envelope and/or jacket tubes can, moreover, be taken into account separately from friction resistances optionally present between the outer peripheries of the envelope and/or jacket tubes and the borehole produced. By such decoupling of the drill bit from the envelope and/or jacket tubes for the introduction of the envelope and/or jacket tubes, it is not necessary, as opposed to known configurations, to introduce the energy required for the introduction of the envelope and/or jacket tubes from the drill rod assembly onto the drill bit and subsequently onto the jacket tube, so that merely the energy required for mining or boring need be transmitted to the drill bit. To ensure a favorable introduction of the energy required for the entrainment or introduction of the envelope and/or jacket tubes into the interior of the borehole by the impact shoe having a comparatively large outer diameter, it is proposed according to the invention that the impact energy is transmitted from the drill rod assembly onto the impact shoe via an interposed impact ring. Such an impact ring allows for the transmission of energy from the centrally arranged drill rod assembly usually having a comparatively small diameter onto the impact shoe having a large diameter, the impact shoe being designed to substantially match the diameter of the envelope and/or jacket tubes coupled therewith. By providing a separate impact ring, it is further possible to take into account the different stresses acting on the individual parts. For a particularly simple and quick removal of at least the drill rod assembly upon completion of a bore, it is further proposed according to the invention that the drill bit and optionally the impact ring are coupled with the drill rod assembly via a plug-in connection.

For a particularly uniform introduction of energy, or transmission of the same onto the drill bit and the impact ring and impact shoe, respectively, using elements that are simple and cost-effective to produce, it is proposed according to a preferred embodiment that the transmission of the impact energy from the drill rod assembly onto the impact shoe and/or the interposed impact ring and onto the drill bit is each effected via abutment or stop surfaces each enclosing an acute angle with the longitudinal axis of the drill rod assembly or having a spherical calotte shape. Such abutment surfaces each enclosing an acute angle with the longitudinal axis of the drill rod assembly or having a calotte shape, in particular, between the drill rod assembly and the drill bit end facing away from the working surface, are simple to produce with the respective tolerances necessary for a proper force transmission.

For the simple and safe haulage of excavated material, it is proposed according to a further preferred embodiment that excavated material is introduced into an annular space defined between the outer periphery of the drill rod assembly and the inner peripheries of the envelope tube and the adjoining jacket tube via at least one passage opening provided in the working surface of the drill bit, and removed from the borehole. The excavated material can, thus, be directly introduced into the annular space between the drill rod assembly and the envelope tube and jacket tube following upon the drill bit through the at least one passage opening provided in the drill bit so as to ensure the reliable and safe removal of excavated material from the region of the working surface of the drill bit.

In order to enable the proper passage of excavated material, which is discharged through the at least one passage opening provided in the working surface of the drill bit, through the impact ring arranged at a distance from the drill bit and provided to transmit the impact energy from the substantially centrally arranged drill rod assembly onto the impact shoe, it is contemplated according to a particularly preferred embodiment that the impact ring is formed with a passage opening for material haulage, which corresponds with the at least one passage opening of the working surface of the drill bit, and coupled with the drill rod assembly for rotational movement with the drill bit.

The completion of a bore, as a rule, is followed by the removal of at least the drill rod assembly from the borehole, whereupon the borehole with the envelope and/or jacket tubes remaining in the borehole is, for instance, filled with a curing mass. For a particularly simple and safe coupling of at least the drill rod assembly, it is proposed according to a further preferred embodiment of the invention that complementary polygonal surfaces of the plug-in connection are provided between the drill bit and the impact ring with the drill rod assembly. Such complementary polygonal surfaces of a plug-in connection allow for the safe coupling with, and reliable force introduction on, the drill bit, while such a plug-in connection readily enables the removal of the drill rod assembly from the drill bit by simple retraction. By providing an impact ring that is separate from the impact shoe, it is, moreover, feasible for the impact ring to remain within the borehole upon removal of the drill rod assembly such that an impediment during the removal of the drill rod assembly through the impact ring having an enlarged diameter relative to the drill rod assembly, by material optionally remaining in the annular space between the outer periphery of the drill rod assembly and the inner diameters of the envelope and/or jacket tubes need be feared.

To achieve the initially defined objects, a device of the initially defined kind is, moreover, essentially characterized in that the drill rod assembly is coupled via an interposed impact ring with the impact shoe for the transmission of impact energy onto the envelope and/or jacket tubes. As already pointed out above, a uniform introduction of the impact or excavation energy to be transmitted onto the drill bit is feasible, whereby the drilling progress or drilling procedure will be accelerated or supported. Furthermore, no special measures have to be taken with regard to partial drill bit zones to be preferably reinforced for the introduction of the impact energy and distribution of the same over the entire working surface. By decoupling the drill bit from the envelope and/or jacket tubes, it is, moreover, feasible to design the drill bit in an accordingly simplified manner, since the forces required for the introduction of the envelope and/or jacket tubes need not be transmitted onto the envelope and/or jacket tubes by the drill bit, but the envelope and/or jacket tubes are introduced into the interior of the borehole via the impact shoe cooperating with the drill rod assembly or acted upon by the same. To provide simple coupling between the drill rod assembly and the impact shoe and the proper introduction of energy onto the impact shoe for the entrainment of the envelope and/or jacket tubes into the interior of the drill rod assembly, it is provided according to the invention that the drill rod assembly is coupled via an interposed impact ring with the impact shoe for the transmission of impact energy onto the envelope and/or jacket tubes. To provide reliable and simple coupling between the drill rod assembly and the drill bit, it is further proposed according to the invention that the drill bit and the impact ring are coupled with the drill rod assembly via plug-in connections.

In this context, it is proposed according to a preferred embodiment that the impact ring is designed to be separate from the impact shoe and the drill rod assembly. This enables individual elements of the device according to the invention to be produced separately from one another and, hence, in a easier manner while, furthermore, ensuring that, upon removal of the drill rod assembly after completion of the bore, as will be further elucidated below, the impact shoe may remain within the borehole besides the drill bit and the envelope and/or jacket tubes so as to enable the simple extraction or removal of the drill rod assembly without having to fear an impediment, during the removal of the drill rod assembly, by excavated material possibly remaining within the borehole on account of the impact ring having a larger external dimension for coupling with the impact shoe.

For the reliable introduction into the interior of the bore hole, of the envelope and/or jacket tubes following upon the drill bit, it is provided according to a further preferred embodiment that the impact shoe is welded with the envelope and/or jacket tubes. By coupling or welding the envelope and/or jacket tubes with the impact shoe, it is ensured that the impact energy to be introduced onto the envelope and/or jacket tubes for the introduction into the borehole, particularly under tensile stress, as in contrast to known configurations will not be initially introduced into the drill bit, whereupon the envelope and/or jacket tubes will be drawn into the borehole via the drill bit, but that decoupling of the advance movement of the drill bit and the entrainment movement of the envelope and/or jacket tubes of the drill bit will take place.

For a particularly reliable haulage of excavated material from the region of the drill bit, it is proposed according to a further preferred embodiment that the drill bit on its working surface comprises at least one passage opening for the introduction of material into an annular space defined between the outer periphery of the drill rod assembly and the inner peripheries of the envelope tube and the adjoining jacket tube. At least one such passage opening enables the reliable introduction of excavated material directly from the region of the working surface of the drill bit into the annular space defined between the outer periphery of the drill rod assembly and the inner peripheries of the envelope tube and the adjoining jacket tube.

In order to enable the proper transport of excavated material even through the region of the impact ring constituting a coupling between the centrally arranged drill rod assembly and the impact shoe located on the outer periphery, it is provided according to a further preferred embodiment that the impact ring comprises at least one passage opening in alignment with the passage opening(s) of the working surface of the drill bit.

To enable as uniform a haulage of excavated material as possible over the total working surface of the drill bit and subsequently through the impact ring, it is provided according to a further preferred embodiment that a plurality of passage openings each at substantially equal angular distances from one another, in particular three passage openings at mutual angular distances of 120°, are provided on the outer peripheral regions of the drill bit and impact ring.

According to a further preferred configuration, it is provided that the plug-in connections between the drill bit and the impact ring with the drill rod assembly comprise polygonal stop or abutment surfaces. Such a plug-in connection with polygonal stop or abutment surfaces enables the reliable transmission of force, particularly also under consideration of the rotational movement to be imparted to the drill bit, whereupon, after completion of the borehole, the separation or detachment of the drill rod assembly from the drill bit and optionally impact ring is effected by the simple retraction of the drill rod assembly.

In order to provide a reliable transmission or introduction of the energy to be introduced from the drill rod assembly onto the drill bit as well as the envelope and/or jacket tubes via the interposed impact ring and impact shoe, it is provided according to a further preferred embodiment that the impact shoe, and optionally the impact ring, as well as the drill rod assembly and the drill bit comprise stop surfaces each enclosing an acute angle with the longitudinal axis of the drill rod assembly or having a spherical calotte shape and provided for the transmission of impact energy from the drill rod assembly onto the drill bit and the impact shoe and impact ring, respectively. Such stop surfaces enclosing acute angles with the longitudinal axis of the drill rod assembly or having spherical calotte shapes can be constructed for the partially high forces to be introduced in an accordingly cost-effective and reliable manner.

In order to enable targeted drilling during the production of a borehole, it is provided according to a further preferred embodiment that a guide tube overlapping the impact shoe is arranged to follow the drill bit on the end facing away from the excavation surface, which guide tube, together with the drill bit, is capable of being rotated relative to the impact shoe as well as the envelope and/or jacket tubes connected therewith. This guide tube has an accordingly short length in order not to excessively increase the frictional forces acting between the outer periphery of the guide tube and the produced borehole, while the envelope and/or jacket tubes are merely subjected to tensile stresses as explained above and, hence, introduced solely in the longitudinal direction of the borehole without rotational movement.

To ensure coupling between the guide tube and the impact shoe, it is provided according to a further preferred embodiment that the guide tube and the impact shoe are secured in the axial direction, for instance, by a spring washer.

SHORT DESCRIPTION OF THE DRAWINGS

In the following, the invention will be explained in more detail by way of an exemplary embodiment schematically illustrated in the drawing. Therein:

DETAILED DESCRIPTION OF THE PREFERRED EMBODIMENTS

In the Figures, a drill bit is generally denoted by 1, which, in a manner known per se, comprises a plurality of hard-metal or hard-material inserts 2 for excavating material not illustrated in detail in order to form a borehole not illustrated in detail, either.

Figure 1:
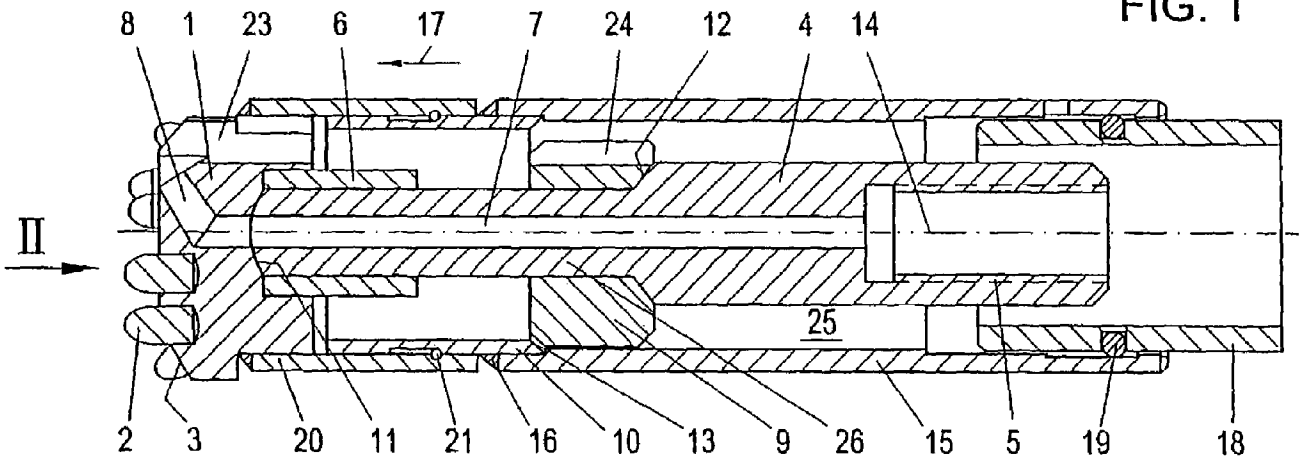
FIG. 1 depicts a longitudinal section through a device according to the invention for carrying out the method of the invention.

As is apparent from FIG. 1, the drill bit 1 is coupled with a drill rod assembly 4 on its side facing away from the working surface 3, FIG. 1 showing but the foremost section of the drill rod assembly 4, wherein the drill rod assembly 4, in a manner known per se, is accordingly extensible, for instance, via a screw connection indicated at 5. The drill rod assembly 4 substantially centrally in the region of a plug-in connection 6 cooperates directly with the drill bit 1, wherein FIG. 1, moreover, schematically indicates a flush channel 7 provided within the drill rod assembly 4 and running into respective flush openings 8 provided in the region of the working surface 3 of the drill bit 1.

In addition to the central coupling of the drill rod assembly 4 with the drill bit 1 in the region of the plug-in connection 6, it is, moreover, provided that the drill rod assembly 4 at a distance from the plug-in connection 6 cooperates with an impact ring 9 which, in turn, cooperates with an impact shoe 10. The impact shoe 10 transmits energy onto an envelope tube 15 via the interposed impact ring 9.

For the simple and proper transmission of impact energy from the drill rod assembly 4 onto the impact ring 9 and, subsequently, onto the impact shoe 10, stop surfaces or abutment surfaces 12 and 13 are provided, said stop surfaces or abutment surfaces 12 and 13 each enclosing an acute angle with the longitudinal axis 14 of the drill rod assembly 4. The abutment surfaces 11 between the drill bit 1 and the central drill rod assembly 4 are calotte-shaped to transmit the required forces.

In addition, it is apparent from FIG. 1 that the impact shoe 10 is connected with the envelope tube 15 via a weld 16 such that an action upon the impact shoe 10 in the direction of the drilling or mining movement 17 will, at the same time, entrain the envelope tube 15 as well as the jacket tube 18 coupled with the envelope tube 15 and following upon the same. Coupling between the envelope tube 15 and the adjoining jacket tube 18 is realized by coupling via a ring 19.

From FIG. 1 it is further apparent that the drill bit end facing away from the working surface 3 is followed by a guide tube 20, which is firmly connected with the drill bit 1 while overlapping the impact ring 10 at least partially. An axial securing means between the impact ring 10 and the guide tube 20 is indicated in FIG. 1 as a spring washer 21.

Figure 3:
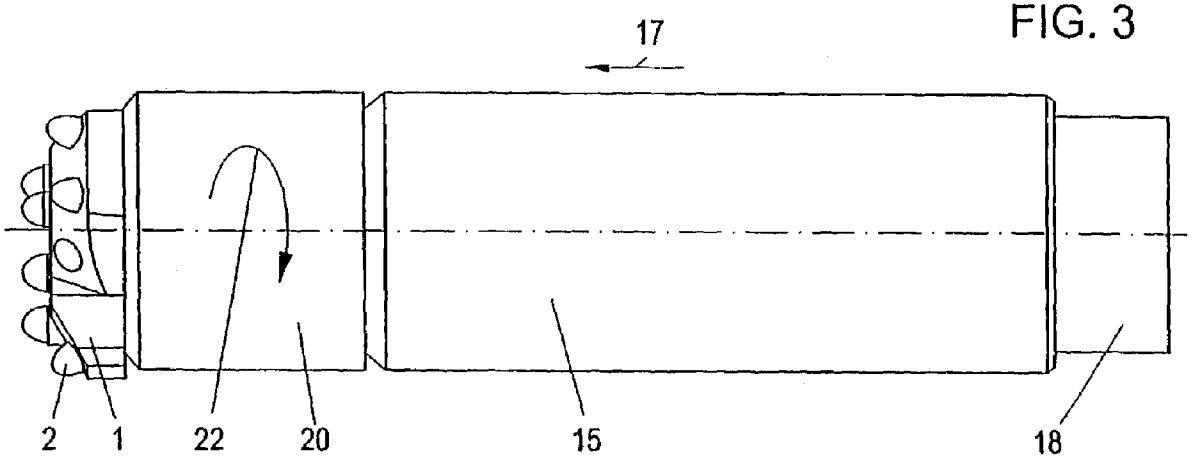
FIG. 3 is a side view of the device according to the invention.

As is particularly apparent from FIG. 3, the guide tube 20 rotates together with the drill bit 1 in the sense of arrow 22 during an excavation procedure, while the envelope tube 15 and the adjoining jacket tube 18 are taken along into the interior of the borehole via the impact shoe 10 solely in the sense of the drilling movement 17 without any rotational movement.

To provide particularly reliable and exact coupling between the drill rod assembly 4 and the drill bit 1, polygonal connection or abutment surfaces are provided in the region of the plug-in connection 6.

Moreover, it is provided that the impact ring 9 is designed to be separate from both the impact shoe 10 and the drill rod assembly 4 such that, upon completion of a borehole, the drill rod assembly 4 can be readily removed from the borehole and, hence, the interior of the envelope tube 15 and the adjoining jacket tube 18 in a direction opposite to the drilling direction 17, whereby no impediment by material present in the interior of the envelope and/or jacket tubes 15 and/or 18, respectively, need be feared, because the impact ring 9 too will remain in the borehole, i.e., in the interior of the envelope tube 15.

Figure 2:
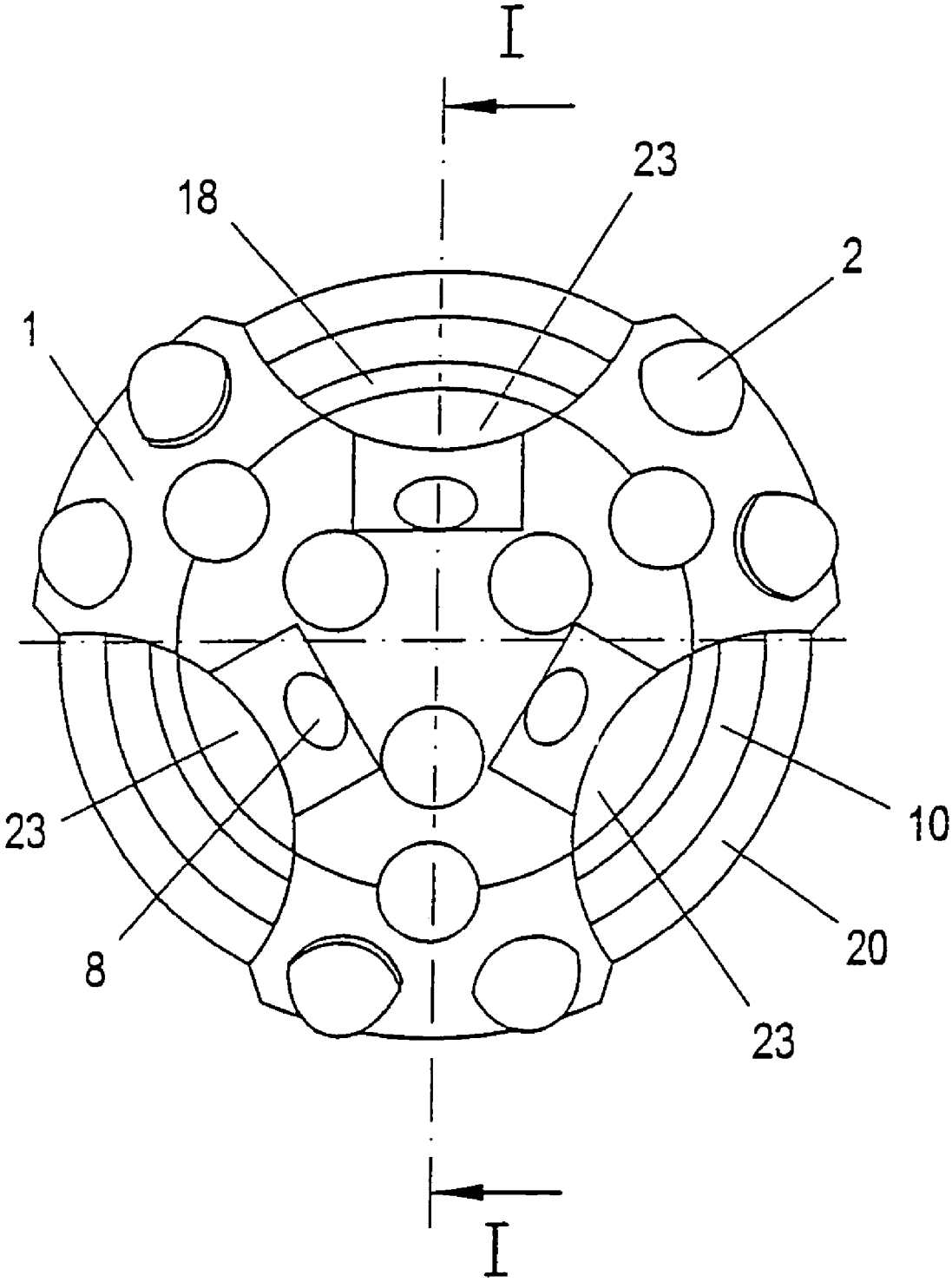
FIG. 2 is a front elevation view of the drill bit of the embodiment according to FIG. 1 in the sense of arrow II, FIG. 1 being a section along line I-I of FIG. 2.

For the proper haulage of excavated material not illustrated in detail, it is provided that the drill bit 1 on its working surface 3 comprises at least one and, in the embodiment illustrated, three passage openings 23, which are each arranged in a substantially equally spaced-apart angular relationship of 120°. It is, in particular, apparent from the schematic view of FIG. 2 that also the impact ring 9 comprises accordingly aligned passage openings 24 so as to provide a large passage cross section that enables the discharging of material directly through the working surface of the drill bit 1 and, subsequently, into the annular space 25 defined between the outer periphery of the drill rod assembly 4 and the inner peripheries of the envelope tube 15 and/or adjoining jacket tube 18.

Considering the fact that the impact ring 9, as pointed out above, is designed separately from both the impact shoe 10 and the drill rod assembly 4, it is, thus, feasible to safely remove or retract the drill rod assembly 4 upon completion of the bore even with coarse material being possibly present in the annular space 25, since, besides the substantially smooth outer periphery of the drill rod assembly 4, which is apparent from the right-hand portion of FIG. 1, partial region 26 having a reduced cross section and surrounded by the impact ring 9 does not constitute an impediment for the removal of the drill rod assembly 4 upon completion of the bore.

The invention claimed is:

1. A method for drilling holes in soil or rock material, the method comprising the steps of forming a borehole by a percussive and/or rotational movement carried out by a drill bit mounted on a drill rod assembly, introducing an envelope tube and/or a jacket tube into the borehole, transmitting impact energy introduced by the drill rod assembly partially centrally by the drill rod assembly onto the drill bit and partially via an impact shoe cooperating with the drill rod assembly onto the envelope and/or jacket tube, transmitting the impact energy from the drill rod assembly onto the impact shoe via an interposed impact ring and that the drill bit and the impact ring being coupled with the drill rod assembly by a plug-in connection, and providing complementary polygonal surfaces of the plug-in connection between the drill bit and the impact ring with the drill rod assembly.

2. The method according to claim 1, wherein the transmission of the impact energy from the drill rod assembly onto the impact shoe and/or the interposed impact ring and onto the drill bit is each effected via abutment or stop surfaces each enclosing an acute angle with the longitudinal axis of the drill rod assembly or having a spherical calotte shape.

3. The method according to claim 1, wherein excavated material is introduced into an annular space defined between the outer periphery of the drill rod assembly and the inner peripheries of the envelope tube and the adjoining jacket tube via at least one passage opening provided in the working surface of the drill bit, and removed from the borehole.

4. The method according to claim 3, wherein the impact ring is formed with a passage opening for material haulage, which corresponds with the at least one passage opening of the working surface of the drill bit, and coupled with the drill rod assembly for rotational movement with the drill bit.

5. A device for drilling holes in soil or rock material, wherein a borehole is formed by a percussive and/or rotational movement, the device comprising a drill bit mounted on a drill rod assembly, an envelope tube and a jacket tube capable of being introduced into the borehole, the drill bit being capable of being acted upon by the drill rod assembly in its central region, the drill rod assembly acting on an impact shoe cooperating with the envelope and jacket tubes, the drill rod assembly being coupled via an interposed impact ring with the impact shoe for transmission of impact energy onto the envelope and jacket tubes, and the drill bit and the impact ring being coupled to the drill rod assembly via plug-in connections, the drill bit, on its working surface, includes at least one passage opening for introduction of material into an annular space defined between an outer periphery of the drill rod assembly and inner peripheries of the envelope tube and the adjoining jacket tube.

6. The device according to claim 5, wherein the impact ring is designed to be separate from the impact shoe and the drill rod assembly.

7. The device according to claim 5, wherein the impact ring comprises at least one passage opening in alignment with the at least one passage opening of the working surface of the drill bit.

8. The device according to claim 5, wherein a plurality of passage openings each at substantially equal angular distances from one another, in particular three passage openings at mutual angular distances of 120°, are provided on the outer peripheral regions of the drill bit and impact ring.

9. The device according to claim 5, wherein the plug-in connections between the drill bit and the impact ring with the drill rod assembly comprise polygonal stop or abutment surfaces.

10. A device for drilling holes in soil or rock material, wherein a borehole is formed by a percussive and/or rotational movement, the device comprising a drill bit mounted on a drill rod assembly, an envelope tube and/or a jacket tube capable of being introduced into the borehole, the drill bit being capable of being acted upon by the drill rod assembly in its central region, the drill rod assembly acting on an impact shoe cooperating with the envelope and/or jacket tube, the drill rod assembly being coupled via an interposed impact ring with the impact shoe for transmission of impact energy onto the envelope end/or jacket tube, and the drill bit and the impact ring being coupled to the drill rod assembly via plug-in connections, a guide tube overlapping the impact shoe arranged to follow the drill bit on an end facing away from a working surface, the guide tube, together with the drill bit, being capable of being rotated relative to the impact shoe as well as the envelope and/or jacket tube connected therewith.

11. The device according to claim 10, wherein the guide tube and the impact shoe are secured in an axial direction by a spring washer.

12. A device for drilling holes in soil or rock material, wherein a borehole is formed by a percussive and/or rotational movement, the device comprising a drill bit mounted on a drill rod assembly, an envelope tube and/or a jacket tube capable of being introduced into the borehole, the drill bit being capable of being acted upon by the drill rod assembly in its central region, the drill rod assembly acting on an impact shoe cooperating with the envelope and/or jacket tube, the drill rod assembly being coupled via an interposed impact ring with the impact shoe for the transmission of impact energy onto the envelope end/or jacket tube, and the drill bit and the impact ring being coupled to the drill rod assembly via plug-in connections, the impact shoe being welded with the envelope tube and/or the jacket tube.

13. A device for drilling holes in soil or rock material, wherein a borehole is formed by a percussive and/or rotational movement, the device comprising a drill bit mounted on a drill rod assembly, an envelope tube and/or a jacket tube capable of being introduced into the borehole, the drill bit being capable of being acted upon by the drill rod assembly in its central region, the drill rod assembly acting on an impact shoe cooperating with the envelope and/or jacket tube, the drill rod assembly being coupled via an interposed impact ring with the impact shoe for transmission of impact energy onto the envelope and/or jacket tube, and the drill bit and the impact ring being coupled to the drill rod assembly via plug-in connections, the impact shoe and the impact ring as well as the drill rod assembly and the drill bit comprise stop surfaces each enclosing an acute angle with a longitudinal axis of the drill rod assembly or having a spherical calotte shape and provided for transmission of impact energy from the drill rod assembly onto the drill bit and the impact shoe and impact ring, respectively.

* * * * *